US007270186B2

(12) United States Patent
Johnson

(10) Patent No.: US 7,270,186 B2
(45) Date of Patent: Sep. 18, 2007

(54) DOWNHOLE WELL PUMP

(75) Inventor: Kenneth G. Johnson, Farmington, NM (US)

(73) Assignee: Burlington Resources Oil & Gas Company LP, Farmington, NM (US)

( * ) Notice: Subject to any disclaimer, the term of this patent is extended or adjusted under 35 U.S.C. 154(b) by 254 days.

(21) Appl. No.: 10/492,732

(22) PCT Filed: Oct. 9, 2002

(86) PCT No.: PCT/US02/32462

§ 371 (c)(1),
(2), (4) Date: Aug. 12, 2004

(87) PCT Pub. No.: WO03/031815

PCT Pub. Date: Apr. 17, 2003

(65) Prior Publication Data

US 2004/0256109 A1 Dec. 23, 2004

Related U.S. Application Data

(60) Provisional application No. 60/327,803, filed on Oct. 9, 2001.

(51) Int. Cl.
*E21B 43/00* (2006.01)

(52) U.S. Cl. ..... 166/369; 166/105

(58) Field of Classification Search ..... 166/369, 166/265, 105.5, 106, 105
See application file for complete search history.

(56) References Cited

U.S. PATENT DOCUMENTS

| | | | | |
|---|---|---|---|---|
| 3,171,630 | A | 3/1965 | Harney et al. | |
| 3,981,626 | A | 9/1976 | Onal | |
| 4,531,593 | A * | 7/1985 | Elliott et al. | 175/71 |
| 4,711,306 | A | 12/1987 | Bobo | 166/372 |
| 5,611,397 | A | 3/1997 | Wood | |
| 6,000,915 | A | 12/1999 | Hartman | |
| 6,082,452 | A * | 7/2000 | Shaw et al. | 166/105.5 |

(Continued)

FOREIGN PATENT DOCUMENTS

| | | |
|---|---|---|
| CA | 2248293 A1 | 3/2000 |
| CN | 2074813 U | 4/1991 |
| GB | 2 342 670 A | 4/2000 |

OTHER PUBLICATIONS

Chinese Office Action, dated Nov. 24, 2006, for counterpart Chinese Patent Application No. 02824563.6; Together with a copy of an English-language translation of the text thereof.

*Primary Examiner*—William P Neuder
(74) *Attorney, Agent, or Firm*—Sidley Austin LLP

(57) ABSTRACT

The pump and pump system of the present invention is designed to remove liquids, gas, sand and coal fines from gas and/or oil well bores. There is a need in the oil and gas industry to develop a more efficient operating pump that is capable of operating in wells that do not have enough bottom hole pressure to lift liquids to the surface causing the well to log off with fluids and if not economic, potentially be plugged prematurely. Additionally, this design will allow the producer the ability to conduct well bore maintenance such as acid flushes for perforation cleaning and scale batch treating for continued scale treatment.

65 Claims, 5 Drawing Sheets

U.S. PATENT DOCUMENTS 6,213,201 B1 * 4/2001 Renkis ..... 166/53
6,260,626 B1 7/2001 Rivas
6,382,317 B1 * 5/2002 Cobb ..... 166/265
6,557,642 B2 * 5/2003 Head ..... 166/381
2002/0059866 A1 * 5/2002 Grant et al. ..... 95/258
2002/0157822 A1 * 10/2002 Tieben ..... 166/68

* cited by examiner

DOWNHOLE WELL PUMP

RELATED APPLICATIONS

This application claims the benefit of prior filed copending U.S. Provisional Application No. 60/327,803 filed Oct. 9, 2001, and is a 371 of PCT/US02/32462 filed Oct. 9, 2002.

FIELD OF INVENTION

The present invention relates generally to a pump system for removing natural hydrocarbons or other fluids from a cased hole, i.e. a well bore. More particularly, the present invention relates to a novel downhole, gas-driven pump particularly suitable for removing fluids from gas-producing wells.

BACKGROUND OF THE INVENTION

Increasing production demands and the need to extend the economic life of oil and gas wells have long posed a variety of problems. For example, as natural gas is produced, from a reservoir, the pressure within the reservoir decreases over time and some fluids that are entrained in the gas stream with higher pressures, break out due to lower reservoir pressures, and build up within the well bore. In time, the bottom hole pressure will decrease to such an extent that the pressure will be insufficient to lift the accumulated fluids to the surface. In turn, the hydrostatic pressure of the accumulated fluids causes the natural gas produced from the "pay zone" to become substantially reduced or maybe even completely static, reducing or preventing the gases/fluids from flowing into the perforated cased hole and causing the well bore to log off and possibly plugged prematurely for economic reasons.

The oil and gas industry has used various methods to lift fluids from well bores. The most common method is the use of a pump jack (reciprocating pump), but pump jack systems have given rise to additional problems. Pump jack systems require a large mass of steel to be installed on the surface and comprise several moving parts, including counter balance weights, which pose a significant risk of serious injury to operators. Additionally, this type of artificial lift system causes wear to well tubing due to pumping rods that are constantly moving up and down inside the tubing. Consequently, pump jack systems have significant service costs, which negatively impact the economic viability of a well.

Another known system for lifting well fluids is a plunger lift system. The plunger lift system requires bottom hole pressure assistance to raise a piston, which lifts liquids to the surface. Like the pump jack system, the plunger lift system includes numerous supporting equipment elements that must be maintained and replaced regularly to operate effectively, adding significant costs to the production of hydrocarbons from the well and eventually becoming ineffective due to lower reservoir pressures than are required to lift the piston to the surface to evacuate the built up liquids.

Thus, there is a need for a safer, longer lived, and more cost effective pump system that effectively removes liquids from well bores that do not have sufficient bottom hole pressure to lift the liquids to the surface.

SUMMARY OF THE INVENTION

It has now been found that that above-referenced needs can be met by a downhole pump system that powered by gas, preferably the gases produced from the subject well or wells.

Specifically, the pump system includes a pump housing having an engine end and a pump end. Disposed within the engine end of the pump housing is an "engine" having impeller or turbine-type blades fixably connected to a shaft disposed within said housing. Upon supplying pressurized gas to the engine-end blades being the shaft rotates. A "pump" is disposed within the pump end of the housing, the pump comprising blades (preferably impeller-type) fixably connected to the same shaft. Upon the rotation of the shaft the pump-end blades lift the well fluids from the well.

In a preferred embodiment of the invention, the gas that drives the pump is provided through a tubing string attached adjacent the engine end of the pump housing and that tubing string is disposed within a larger diameter production tubing string. In this configuration well fluids are produced through the annulus formed between the production tubing string and the smaller diameter tubing string holding the pump.

In another preferred embodiment of the invention, the pump housing has an outer diameter of at least 3.25 inches.

In yet another embodiment of the invention, a method of producing fluids from a well is provided whereby a gas (preferably the gas from the subject well or wells) is supplied to a pump disposed in a well, the pump including (1) an engine portion that is powered by said pressurized gas and effectuates a rotation of a vertical shaft disposed within said pump and (2) a pump portion that lifts fluids from said well by blades disposed within said pump portion affixed to said rotating shaft. In a preferred embodiment of this method a compressor is used to control the pressure of the gas and a separator disposed upstream from the compressor to separate liquids from the gas.

BRIEF DESCRIPTION OF THE DRAWINGS

For a more complete understanding of the present invention and for further advantages thereof, reference is now made to the following description, taken in conjunction with the accompanying drawings, in which.

DETAILED DESCRIPTION OF THE PREFERRED EMBODIMENT

Figure 1:
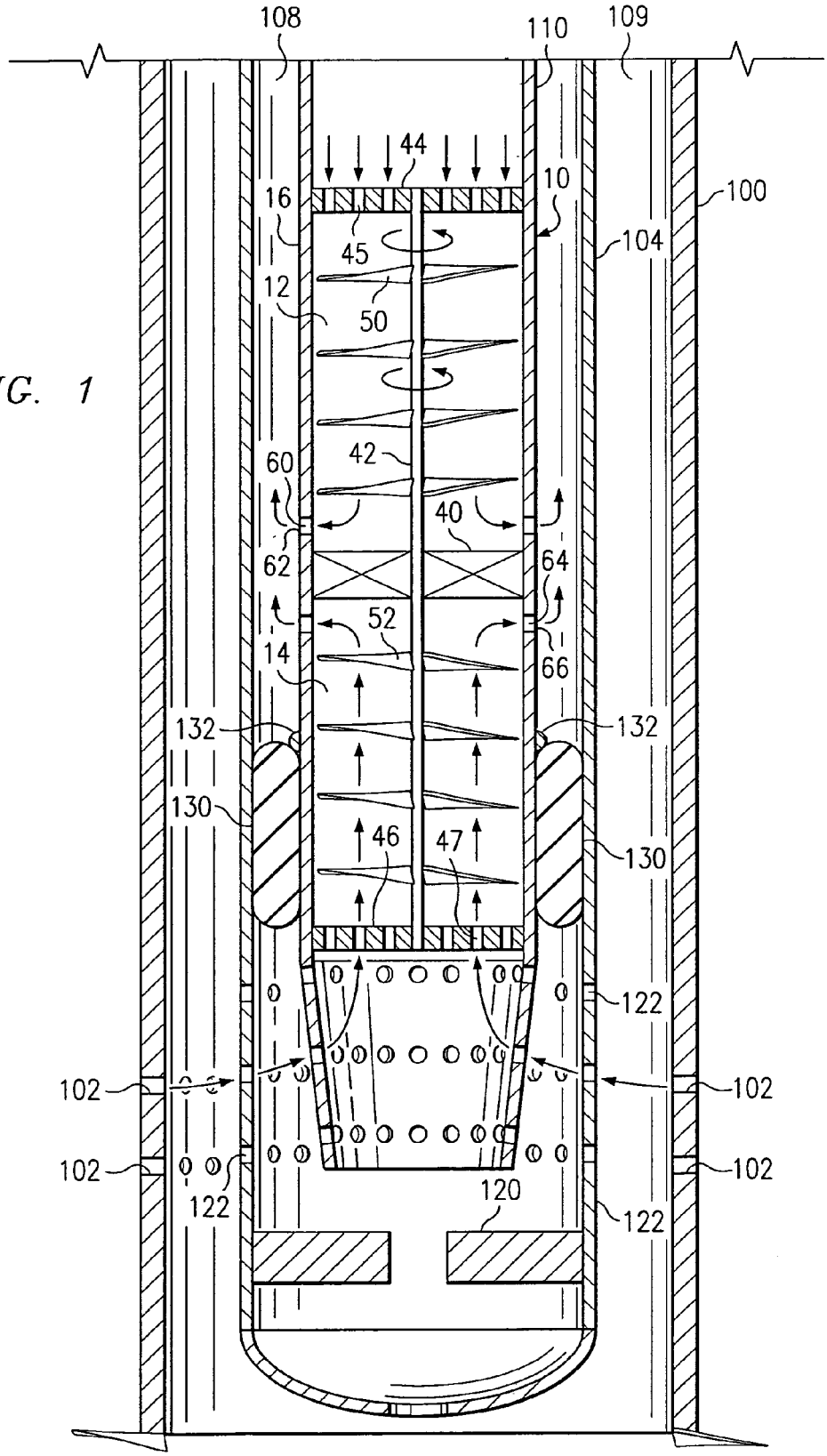
FIG. 1 is cross section view of the down-hole pump of the pump system in a preferred embodiment of the invention.
Figure 2:
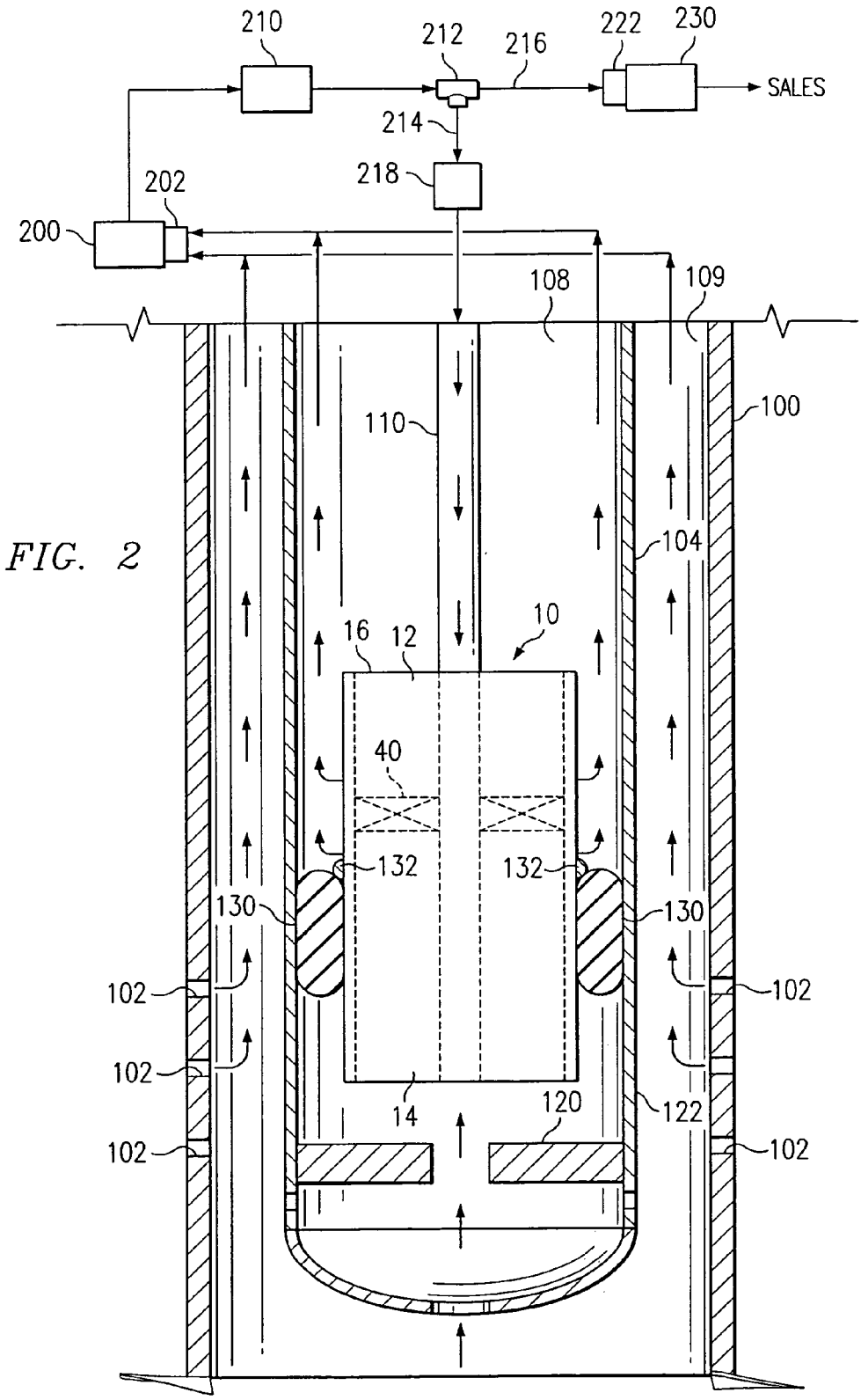
FIG. 2 is a schematic view of the down-hole pump and system of a preferred embodiment of the invention.

The present invention is a novel pump and pump system for use in the removal of liquids from wells, especially, but not limited to, wells that have insufficient bottom hole pressure to lift the well liquids out of the well bore and to the surface. Referring to FIGS. 1 and 2, a first preferred embodiment of the present invention shall be described. FIG. 1 and FIG. 2 illustrate a section of a typical hydrocarbon well completion, which includes a casing string 100 with perforations 102 adjacent the hydrocarbon- producing formation and a production tubing string 104 with perforations 106. The production tubing 104 is installed with a down hole standing valve or check valve 120 in the cased hole or well bore. Preferably, the check valve/standing valve 120 is threaded onto the bottom of the production tubing 104, just above a perforated tubing sub 122. This configuration allows for the pump 10 and 1" tubing 110 to be removed without exposing the formation to any produced fluids and/or material that are captured inside of the annulus 108 between the production tubing 104 and the 1" tubing 110. In the event that a need was presented requiring the release of this fluid, the bottom of the standing valve (ball and seat) 120 could be knocked off and a "Slickline" tool could be used to remove the standing valve. Additionally, the operator would have the option of removing the liquids out of the tubing by means of forced air or any other type of pressure through the annulus that would make the tubing void of any fluids or material prior to removing the standing valve 120.

The pump of the present invention, generally 10, is disposed within the production tubing string 104 at a depth adjacent perforations 102 in casing 100. Production tubing string 104 and casing 100 are conduits whose use, construction and implementation are well known in the oil and gas production field. Pump 10 includes an engine end 12 and a pump end 14, both encased in barrel 16. The pump, as shown in the embodiment of FIGS. 1 and 2, is designed to fit within the well's production tubing and its size is determined by a number of factors, down hole temperatures, such as production tubing size, casing size and the amount of liquids and/or particulates (e.g., sand and coal fines) to be removed.

In a preferred embodiment on the invention shown in FIG. 1 and FIG. 2, pump 10 is attached at the end of a 1-inch diameter (outer diameter) tubing string 110. Preferably, the pump is threaded onto the bottom of the 1-inch tubing and inserted into the production tubing 104, setting the pump into a standard API seating nipple 130 and hanging the top of the 1-inch diameter tubing 110 in a set of tubing slips that are part of the wellhead on the surface. As shown, tubing string 110 and pump 10 are disposed within the production tubing string 104, which is disposed within casing 100. For the purposes of this invention, pump 10 need not be disposed entirely within production tubing string and may extend below the lower end of the production tubing string in the embodiment shown.

Although shown as one inch tubing, the tubing string 110 that supports pump 10 is not limited to one inch tubing and is preferably sized to meet the particular needs of the well. For example, tubing string 110 may comprise larger diameter tubing if large amounts of liquid are produced and must be lifted from the well. In sizing the tubing string 110, there are several factors to be taken into consideration, including the required feeding pressure/gas volume required to operate the engine end of the pump, the tensile strength of the tubing that the operator desires in the wellbore, the size of the production tubing, the size of the well casing, and the amount of fluids that are calculated to be removed from the wellbore.

Figure 3:
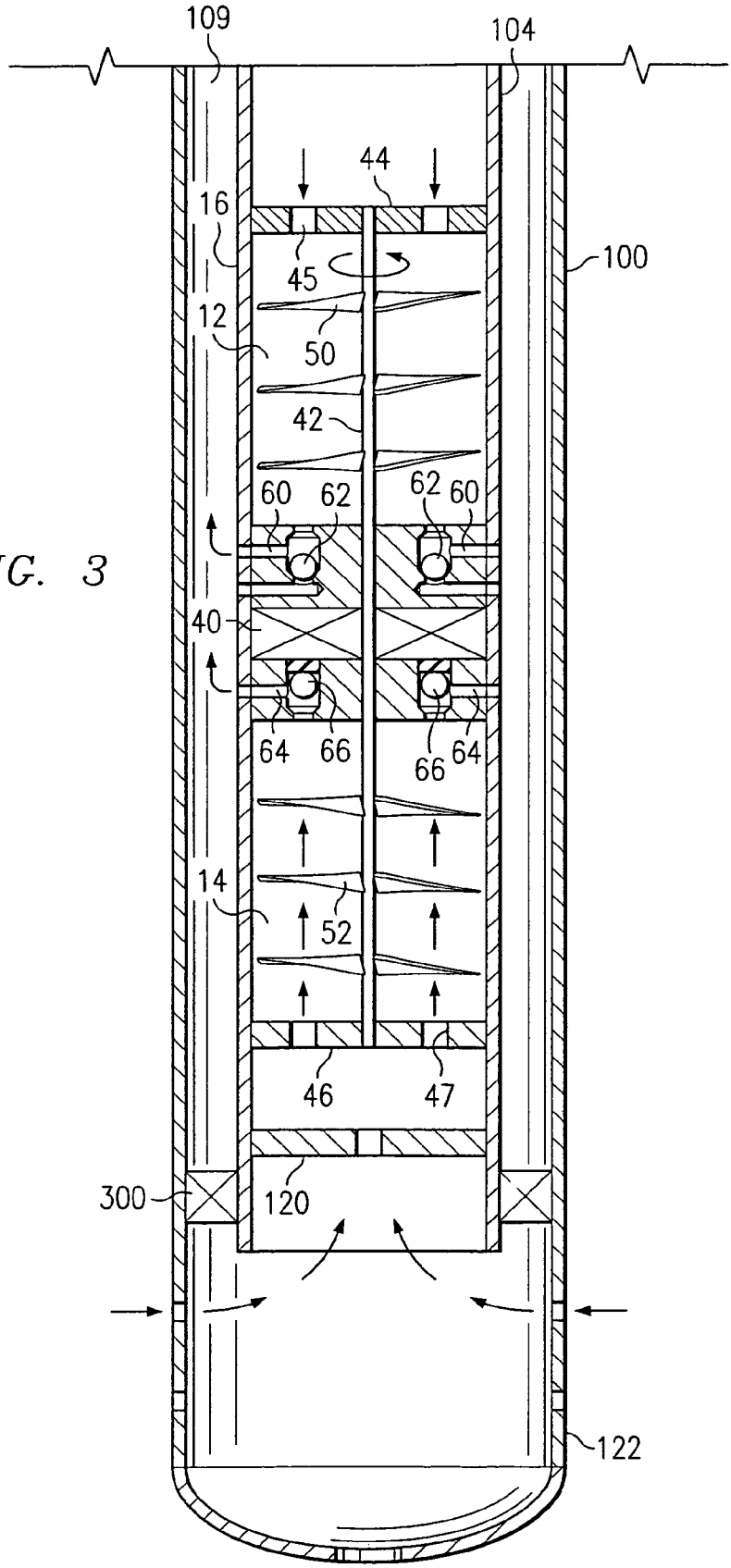
FIG. 3 is schematic view of the down-hole pump and system of an alternative embodiment of the invention.

Alternatively, instead of attachment to the end of a 1-inch tubing string disposed within a production tubing string, pump 10 can be attached (threaded attachment) to the end of the production tubing string 104 or the tubing string nearest the face rock (see FIG. 3). In this alternative embodiment, a seal assembly would be disposed at the top of pump 10 into which a tubing string or pipe can be inserted to supply appropriate gas pressure to the engine end of the pump.

Referring to FIG. 1 and FIG. 2, the pump 10 and pump system shall be described. The components of pump 10 are encased in a cylindrical steel housing (pump barrel) 16 much like conventional, well-known rod pumps. The pump and its components can be constructed of any suitable material, such as stainless steel, which will enable it to be utilized in harsh or corrosive conditions. External seating cups 132 are disposed on the pump barrel, to isolate the engine end gas from the produced hydrocarbons, when utilized in the smaller diameter tubing. The seating cups 132 rest upon a seating nipple 130 installed in the production tubing 104.

As stated previously, the pump includes an engine end 12 and a pump end 14 disposed within the housing 16 (FIG. 1). The engine end and the pump end may be separated by a permanent packed bearing, maintenance free needle or metal to metal type bearing 40 (preferably high temperature) and are operably connected by a common rod or shaft 42 that extends into the engine and pump ends of the pump 10. Additionally, both ends of the pump preferably include stabilizer permanent packed or maintenance free bearings 44 and 46 (preferably high temperature) with ports 45 and 47 for fluid and/or gas entry. This arrangement allows the pump to operate in a vertical or any angle, including all the way to a horizontal position without a loss of efficiency or unnecessary pump wear. Attached to the shaft 42 in the engine end 12 of the pump are blades 50 that are pitched to move fluids (especially gas) away from the ported bearing 44 in the engine end. Although blades 50 are shown as impeller blades, in a preferred embodiment blades 50 are not impeller-type blades, but instead is a turbine type blade design such as that disclosed in U.S. Pat. No. 4,931,026 (see reference numeral 14), which is hereby incorporated by reference.

Still referring to FIGS. 1 and 2, exhaust ports 60 are provided in the engine end of the pump above bearing 40 to allow the driving gas to exhaust from the engine end of the pump. These exhaust ports are provided with a ball check valve 62 that opens under pressure from the driving fluids and closes to prevent fluid from entering the engine end through the exhaust ports when the pump is idle (See FIG. 3, reference numerals 60, 62, 64 and 66 for ball check valve configuration). Attached to the shaft in the pump end 14 of the pump are blades 52 (axial impeller blades) that are pitched to move fluids upward toward exhaust ports 64 in the pump end 14. Exhaust ports 64 are provided with a ball check valve 66 that opens when fluids are being lifted by the moving blades 52 in the pump end and closes to prevent fluid from entering the pump end through the exhaust ports 64 when the pump is idle. As shown (FIGS. 1-3), the axial turbine/turbines in the engine end are driven by pressurized (gas) to create the correct amount of torque and/or revolutions per minute (RPM) of the shaft to create substantially reduced pressures at the pump inlet ports via the axial impellers in the pump end.

In a preferred embodiment of the invention, pump 10 would be driven by the natural gas produced from the well. Generally, natural gas from the producing formation and/or formations will flow up the production tubing or the annulus 109 between the production tubing and the casing 100 to a separator 200 at the surface, which then feeds a surface compressor 210. Preferably, the surface compressor/compressors 210 would be designed to have sufficient engine horsepower (HP), engine and gas water cooling, and compressor design, to exceed the highest pressure required to move the static column of fluid that will exist if the pump were to become idle. Additionally, the compressor preferably would be versatile enough to adapt to a wide range of inlet and discharge pressures without rod loading the compressor or having the engine die due to not enough HP. This versatility would allow the operator to adjust the discharge pressure or gas volume that feeds the pump engine. This would further allow the operator to adjust the surface pressure feeding the compressor 210 from the surface separator 200, thereby allowing the operator to achieve optimum well bore protection and gas/oil flow.

In the arrangement shown (see FIG. 2), the pressure relieved off of the producing formation can be controlled utilizing the inlet control valve 202 on the surface separator which may prevent damage to producing sands/shale's. At the discharge line of the compressor 210 a pipe "tee" 212 would be installed with a line 214 being laid back to the well bore to connect to the 1" diameter (or larger) tubing (the "drive line") to which the pump 10 is connected and a second line 216 extends from the tee joint to a sales line. At this stage, any chemicals required to produce the well such as paraffin, methanol for hydrates prevention, and corrosion can be injected into the 1" tubing 110, and swept down to the engine end 12 of the pump 10. A standard type of continuous injection chemical pump (e.g., natural gas or electric), and either a threaded or welded ½" collar installed on the pipe for the injection point are suitable for this purpose. This will allow the chemicals to have contact with produced fluids to perform their functions while providing maximum protection for the producing horizon/horizons from coming in contact with these chemicals.

Continuing with the description of the preferred process/method of operation, a portion of the pressurized gas from the compressor 210 is discharged through the tee joint 212 into the 1 inch drive line 110, with the remainder of the pressurized gas being discharged into the sales line 216 to continue on to sales. The amount of gas needed to be directed to drive the pump 10 is adjustable by operation of an adjustable valve 218. For example, the adjustment of the amount of gas can be achieved utilizing a manual choke that can be locked at different settings or with a motor valve that can be operated either with a pneumatic pressure controller alone or utilizing remote communications technology. The amount of gas needed to operate the pump 10 will be dependent upon the pitch of the blades, length of the "axial turbine" in the pump barrel, and the pressure required to lift the annular fluids, as well as other factors.

As illustrated in FIGS. 1 and 2 (gas path indicated by arrows), the drive gas discharged into the tubing string 110 enters the pump through the ported bearing 44 at the engine end 12. The pressurized gas entering the engine end then acts upon the blades 50 causing the blades and shaft 42 to rotate. Then, the pressured driving gas (fluid) is exhausted from the engine through the exhaust ports 60 located just above the isolation bearing 40 and into the annulus 108 between the one-inch tubing string and the production tubing. With the common shaft rotating, the blades 52 in the pump end 14 rotate as well, causing a vacuum (or suction) effect which draws fluid from the well through the ported bearing 46 at the pump end. The well fluids drawn into the pump end 14 are then forced toward and through the exhaust ports 64 located just below the isolation bearing 40 and into the annular space 108 between the 1-inch tubing 110 and the production tubing 104. The well fluids then combine with the driving fluids in this annular space and flow toward the surface and to the separator 200. The mixture of the produced liquids and the natural gas utilized for power, will create a lighter gravity fluid in the annular space 108 between the production tubing and the 1-inch tubing allowing for less force (pressure) to be required to lift both to the surface for separation. FIG. 2 illustrates the flow of gas (arrows indicating flow) in a preferred embodiment of the pump system.

As is evident from the description above, the preferred process is repetitive, thus keeping the well bore clear of produced liquids and sand while allowing less back pressure on the face rock. By producing up the casing annulus without the back pressure or friction losses generally created by free liquids, the face rock or producing horizon will yield additional amounts of gas and/or oil. This will extend the life of the well, thus enabling the operator to recover potential incremental reserves that may be otherwise uneconomic to produce utilizing existing conventional artificial lift methods.

Further, although the ball check valves used at the exhaust ports in both the engine and pump ends of the pump have the primary purpose of preventing/reducing back flow of fluids into the pump, they also provide a secondary benefit of allowing pressure testing of the production tubing from the surface to check for any mechanical failures. This may be done utilizing a pump truck that fills the annulus between the 1-inch and the production tubing with a neutral fluid, usually produced or salt water, and then pressures up to a calculated pressure. Significant pressure leak-off may indicate that a mechanical failure of the 1-inch tubing has occurred. This can be determined by an increase in pressure in the 1-inch tubing as the annulus pressure depletes. The ball checks prevent the test fluids (and any debris or other foreign material) from entering the pump. Should the 1 inch tubing not show a mechanical failure then the operator can evaluate if a rig is required to remove or unseat the pump and again apply pressure to the production tubing to see if leak off occurs. This would determine if the mechanical failure is in the production tubing. The check valve 120 installed at the bottom of the production tubing 104 would allow for this test procedure.

Additional benefits can be derived from the system described herein. For example, the system described above provides a means to increase liquid removal from produced gasses. Simultaneously acting with the process above will be an effective method of liquid removal from the compressor discharge gas prior to sales or custody transfer of the gas. This will occur due to the reduction of gas pressure utilized for driving the pump engine to the existing sales line pressure. The hot gas from the discharge of the compressor that is not utilized for operation of the pump will cool when it is controlled or experiences a pressure drop caused by the separator inlet controller. This will cause some of the entrained water and/or oil condensate to separate out of the sales gas stream and be recovered, utilizing the surface equipment on location. Thus, in the preferred embodiment of the invention, the primary (three-phase) separator 200 would remove all free liquids that are initially removed from the wellbore prior to feeding the pressure to the inlet of the compressor 210. Then all produced liquids and any excess gas that is not utilized in the process of operating the pump and will be controlled or choked back down to the sales-line pressure utilizing an inlet control valve 222 installed on a second (two-phase) separator 230 that removes produced liquids and liquids that have fallen out of the gas stream due to pressure drop, allowing less saturated "cleaner" gas to continue on to the sale line 216 at line pressure and temperature.

Referring to FIG. 3, there is shown an alternative embodiment of the pump and pump system of the present invention. The same reference numerals used above and shown in FIGS. 1 and 2 are used in FIG. 3 for like components and processes. FIG. 3 depicts an alternative configuration where the pump 10 is attached directly to the production string 104 rather than a one-inch tubing string. As shown, in this alternative embodiment, the pump is not set in a seating nipple. Further, in this embodiment, it is preferred that production tubing 104 is held in place with a packer 300. In this embodiment, the process and system functions are the same as those described above; however, the pump 10 lifts fluids through the annulus 109 between the production tubing 104 and casing 100. These fluids are lifted and then processed at the surface as described in connection with FIGS. 1 and 2.

In another alternative embodiment of the pump system, a central compressor with a distribution piping system (holding a set pressure) can be used. This alternative configuration would give the same effect as having a wellhead compressor and is akin to a gas lift system where the power natural gas would be delivered to the well from one central site to cover several wells (e.g., 100-200 wells). In this alternative embodiment, the gas flow would be the same as that shown in FIG. 2 and described above in connection with FIGS. 1 and 2, with the exception that only one surface separator would be needed.

Figure 4:
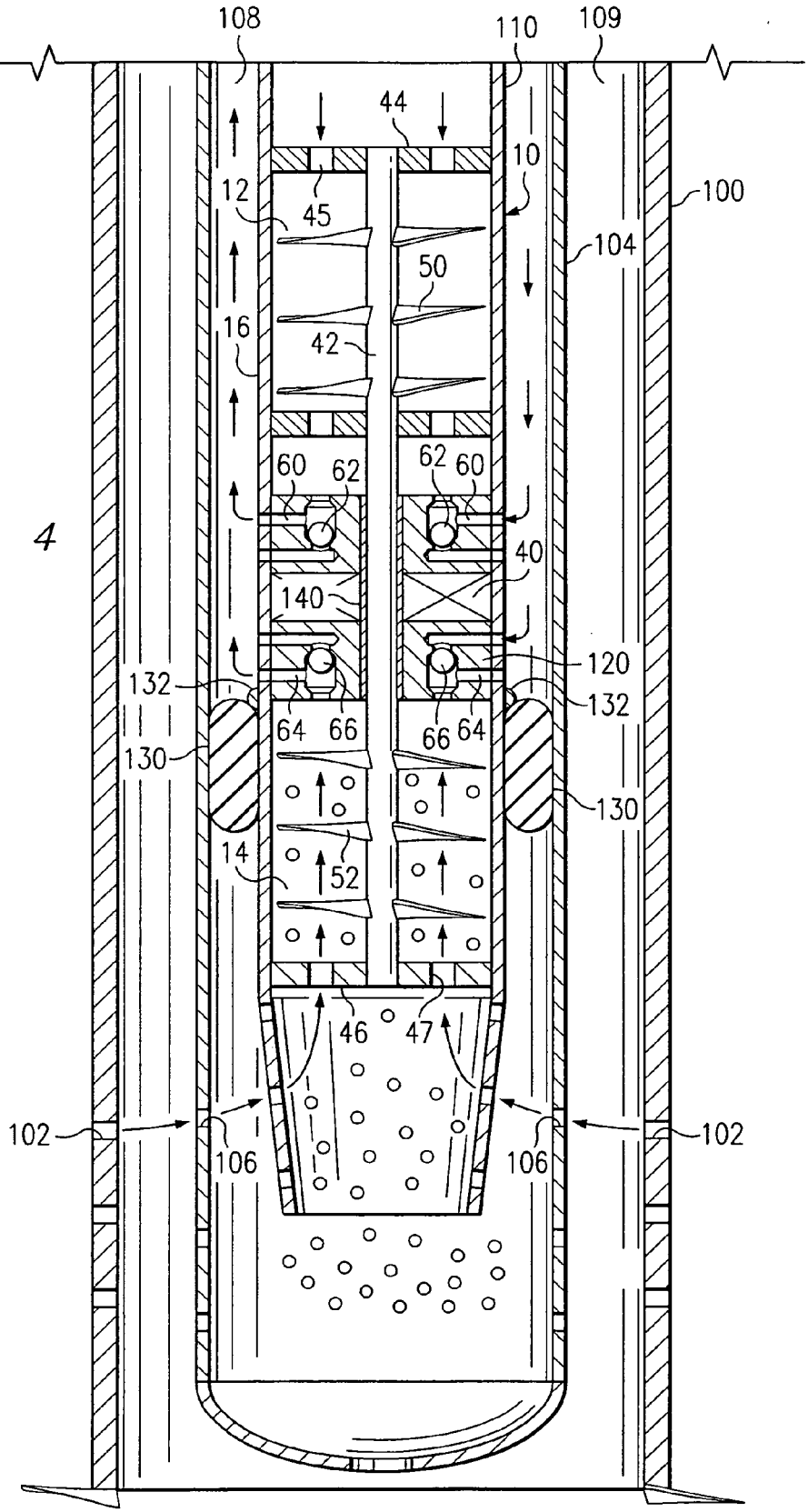
FIG. 4 is a schematic view of the down-hole pump of another alternative embodiment of the invention.

Reference is made to FIG. 4 for another alternative embodiment of the present invention. The same reference numerals used above and shown in FIGS. 1-3 are used in FIG. 4 for like components and processes. Accordingly, the above descriptions made in conjunction with FIGS. 1-3 apply with respect to the alternative embodiment depicted in FIG. 4 and will not be repeated. Like FIGS. 1 and 2, FIG. 4 depicts a configuration designed to produce well fluids between the annulus 108 formed between tubing string 110 and the larger diameter production tubing string 104. FIG. 4 illustrates a section of a hydrocarbon well completion, which includes a casing string 100 with perforations 102 adjacent the hydrocarbon-producing formation and a production tubing string 104 with perforations 106. The production tubing is installed in the cased hole or well bore. In the embodiment of FIG. 4, check valve/standing valve 120 is a removable standing valve or vertical check valve that is installed into the seating nipple or "O-Ring" assembly 130 of the tubing string 104. The seating nipple 130 is located at the bottom of the production string or one (1) joint of pipe up from the bottom such that it is disposed below. This configuration allows for the pump 10 and 1" tubing 110 to be removed without exposing the formation to any produced fluids and/or material that are captured inside of the annulus 108 between the production tubing 104 and the 1" tubing 110. In the event that a need was presented requiring the release of this fluid, the standing valve 120 would be removed utilizing a "Slickline" tool. Additionally, the operator would have the option of removing the liquids out of the tubing by means of forced air or any other type of pressure forced down the annulus that would make the tubing void of any fluids or material prior to removing the standing valve 120.

Still referring to FIG. 4, turbine blades or turbine means 50 are schematically depicted in the engine portion of the pump 10. For a more detailed description and depiction of suitable pump engine turbine means reference is made to U.S. Pat. No. 4,931,026 (see generally reference numeral 14), which has been incorporated by reference. Because of the high rotational speed created by the turbine configuration (e.g. 20,000-30,000 rpm), it is preferred that a vertical stabilizer bearing 140 be used as shown.

Figure 5:
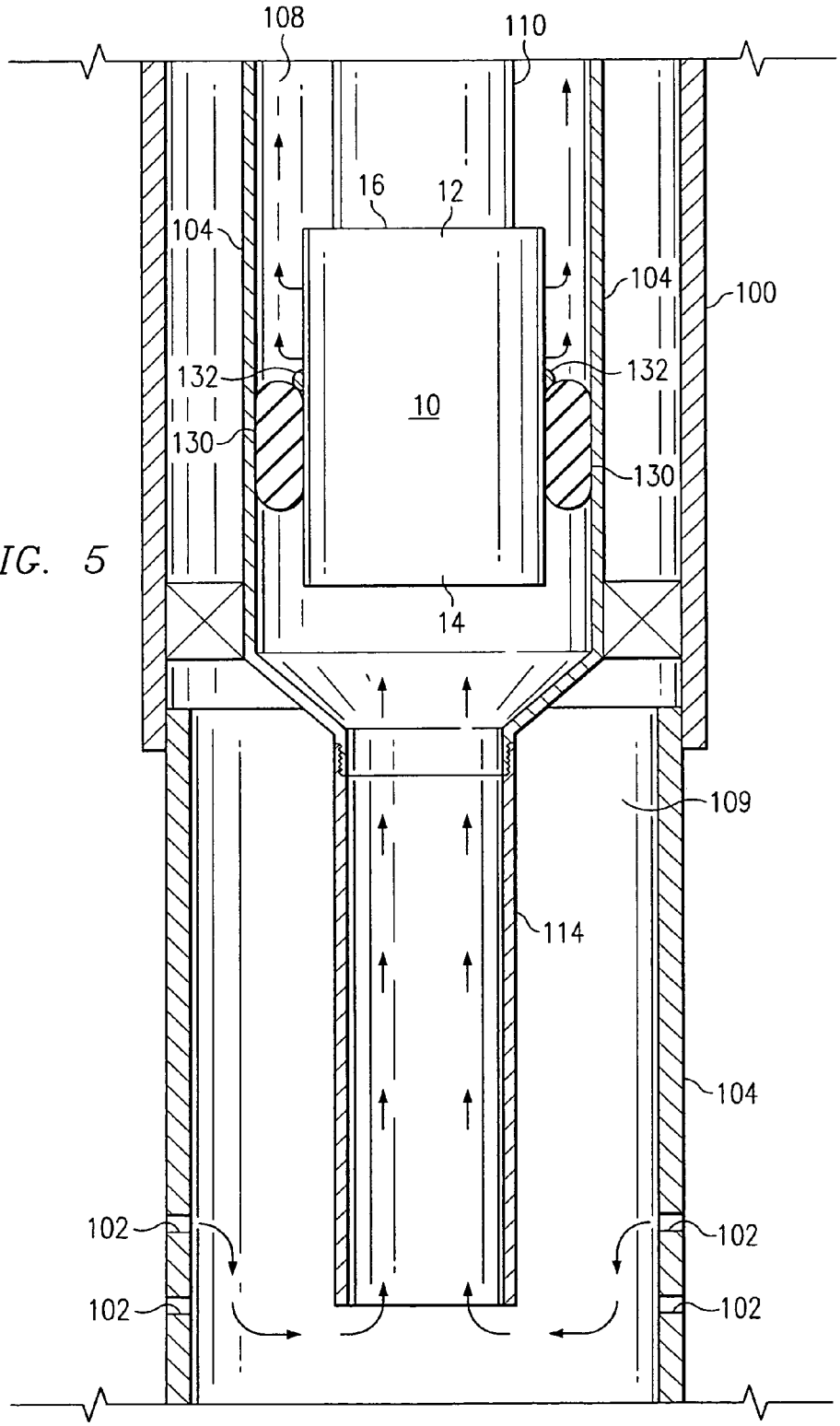
FIG. 5 is a schematic view of the down-hole pump of another alternative embodiment of the invention.

Reference is made to FIG. 5 for another alternative embodiment of the present invention. The same reference numerals used above and shown in FIGS. 1-4 are used in FIG. 5 for like components and processes. Accordingly, the above descriptions made in conjunction with FIGS. 1-4 (including the design of pump 10) apply with respect to the alternative embodiment depicted in FIG. 5 and will not be repeated. As shown in FIG. 5, a larger diameter pump 10 is threaded onto a larger tubing string 110 (e.g., 2⅜ inch OD tubing) than that depicted in FIGS. 1 and 4 (1 inch tubing). In this alternative configuration, the pump 10 is located above the perforations 102 formed in larger diameter casing 100, such as a liner top. In a preferred aspect of this embodiment of the invention, pump 10 is housed within a housing or barrel 16 having an outer diameter of at least 3.25 inches. As shown in FIG. 5, pump 10 is disposed within a section of 3.25 inch (OD) tubing which is threaded to a 2⅜ inch tubing section 110 above the pump 10. As shown, pump 10 is fixed within a 4½ inch production tubing section 104 by a seating nipple or a seating cup 132 which holds the pump in place and isolates the engine end 12 from the pump end 14 of the pump. The 3.25 inch tubing section 104 is threaded below pump 10 to 2⅜ inch tubing (tail pipe) 114. In a preferred aspect of this embodiment of the invention, a packer is set below the pump instead of a down hole standing valve. Further, as shown in FIG. 5, preferably a string of "tail pipe" 114 or several joints of tubing extend below the pump 10, with the tail pipe set or landed at the optimum place in the perforations. In a most preferred configuration, the tail pipe is smaller in diameter (e.g. 1½ inch) than the tubing string 110 feeding the engine of pump (e.g., 2⅜ inch). This preferred configuration would increase velocity of fluids entering the tail pipe and would produce increased torque pressures for setting and releasing the packer. Further, this configuration will allow more gas volume and less friction loss to the engine end, and increase velocities in the smaller diameter tubing installed inside the larger casing.

The various embodiments of this invention have been described herein to enable one skilled in the art to practice and use the invention. Its is understood that one skilled in the art will have the knowledge and experience to select suitable components and materials to implement the invention. For example, those skilled in the art will understand that components such as bearings, seals and valves referenced herein will be selected to effectively withstand and operate in the harsh pressure and temperature environments encountered in an oilk or gas well.

Although the present invention has been described with respect to preferred embodiments, various changes, substitutions and modifications of this invention may be suggested to one skilled in the art, and it is intended that the present invention encompass such changes, substitutions and modifications.

The invention claimed is:

1. A downhole well pump system comprising:

a pump housing having an engine end and a pump end;

an engine disposed within said engine end of said housing, said engine comprising at least one engine-end blade fixably connected to a shaft, said shaft being vertically disposed within said housing and said at least one engine-end blade being designed to cause said shaft to rotate when a pressurized gas flows across said at least one engine-end blade;

a pump disposed within said pump end of said housing, said pump comprising at least one pump-end blade fixably connected to said shaft, said at least one pump-end blade being designed to lift well fluids vertically upon rotation of said shaft; and a string of tubing disposed within a wellbore and attached to said housing for providing a conduit through which said pressurized gas is supplied to said engine, said tubing string having an outer diameter and an inner diameter, wherein said pump housing has an outer diameter greater that the inner diameter of said tubing string.

2. The downhole well pump system of claim 1 wherein said at least one engine-end blade comprises a plurality of blades.

3. The downhole well pump system of claim 2 wherein said plurality of blades comprises impeller-type blades.

4. The downhole well pump system of claim 2 wherein said plurality of blades comprises turbine-type blades.

5. The downhole well pump system of claim 1 wherein said at least one pump-end blade comprises a plurality of blades.

6. The downhole well pump system of claim 5 wherein said plurality of blades comprises impeller-type blades.

7. The downhole well pump system of claim 1, further comprising a check valve at an outlet of said pump.

8. The downhole well pump system of claim 7 wherein said pump housing having an outer diameter of at least 3.25 inches.

9. The downhole well pump system of claim 1, further comprising a check valve at an outlet of said engine.

10. A method of producing fluids from a well comprising:
collecting fluids produced from said well;
separating liquid from gas in said fluid;
compressing said gas to control the pressure thereof; and
supplying said compressed gas to a pump disposed in said well, said pump including (1) an engine portion that is powered by said pressurized gas and effectuates a rotation of a vertical shaft disposed within said pump and (2) a pump portion that lifts fluids from said well by blades disposed within said pump portion affixed to said rotating shaft.

11. A method of producing fluids from a well comprising:
receiving pressurized gas, the pressurized gas including gas produced from the well, the well including a well casing surrounding a tubing string and an annulus between the casing and the tubing string, the annulus being open from a pay zone to a point upwell of a pump disposed in the well and the annulus being in fluid communication with a point adjacent a wellbore opening at the surface; and
supplying the pressurized gas to the pump disposed in the well, the pump adapted for employing the pressurized gas for generating a force for lifting the fluids from the well, wherein the pressurized gas is supplied to the pump prior to the pressurized gas entering a sales line.

12. A method in accordance with claim 11 wherein said pump is disposed at a pay zone within the wellbore of said well.

13. A method in accordance with claim 11, wherein said pump includes an engine portion and a pump portion, said method further comprising:
driving said engine portion with said gas; and
lifting said fluids from said well using said pump portion.

14. A method in accordance with claim 13, wherein said pump portion is attached to a production tubing string in said well.

15. A method in accordance with claim 11, wherein said pump includes an engine portion and a pump portion, said method further comprising:
driving said engine portion with said pressurized gas to effectuate movement of a shaft disposed within said pump; and
driving said pump portion with said movement of said shaft to lift said fluids from said well.

16. A method in accordance with claim 15, wherein said movement of said shaft is in a rotational direction.

17. A method in accordance with claim 15, wherein said step of driving said pump portion includes driving a blade disposed within said pump portion with said movement of said shaft to lift said fluids from said well.

18. A method in accordance with claim 15, wherein said step of driving said pump portion includes driving at least one impeller blade disposed within said pump portion with said movement of said shaft to lift said fluids from said well.

19. A method in accordance with claim 15, wherein said step of driving said engine portion includes flowing said gas across a blade disposed within said engine portion to effectuate movement of said shaft.

20. A method in accordance with claim 15, wherein said step of driving said engine portion includes flowing said gas across at least one impeller blade disposed within said engine portion to effectuate movement of said shaft.

21. A method in accordance with claim 15, wherein said step of driving said engine portion includes flowing said gas across at least one turbine blade disposed within said engine portion to effectuate movement of said shaft.

22. A method in accordance with claim 11, wherein said fluid comprises liquid and gas, said method further comprising separating said liquid from said gas.

23. A method of producing fluids from a well comprising:
compressing at least a portion of gas produced from said well with a compressor to produce pressurized gas;
receiving said pressurized gas, said pressurized gas including gas produced from said well; and
supplying said pressurized gas to a pump disposed in said well, said pump adapted for employing said pressurized gas for generating a force for lifting said fluids from said well.

24. A method in accordance with claim 23, wherein said compressor is a wellhead compressor.

25. A method in accordance with claim 23, wherein said compressor is a central compressor, said method further comprising distributing said pressurized gas via a distribution piping system.

26. A downhole well pump system comprising:
a pump configured to employ pressurized gas for generating a force for lifting fluids from a well, the pressurized gas including gas produced from the well, the well including a well casing surrounding a tubing string and an annulus between the casing and the tubing string, the annulus being open from a pay zone to a point unwell of a pump disposed in the well and the annulus being in fluid communication with a point adjacent the wellbore opening at the surface, wherein at least a portion of the pressurized gas is supplied to the pump via the tubing string prior to the pressurized gas entering a sales line.

27. A downhole well pump system in accordance with claim 26 wherein said pump is disposed at the pay zone within a wellbore of said well.

28. A downhole well pump system in accordance with claim 26 wherein said pump includes a check valve on an outlet thereof.

29. A downhole well pump system in accordance with claim 26, wherein said pump comprises an engine portion and a pump portion, said pump portion attached to a production tubing string in said well.

30. A downhole well pump system in accordance with claim 26, wherein said pump comprises:
a shaft disposed within said pump;
an engine portion adapted to employ said gas to effectuate movement of said shaft; and
a pump portion, adapted to employ said movement of said shaft to lift said fluids from said well.

31. A downhole well pump system in accordance with claim 30, wherein said movement of said shaft is in a rotational direction.

32. A downhole well pump system in accordance with claim 30 wherein said pump further comprises a blade disposed within said pump portion, said blade adapted for lifting said fluids from said well based on said movement of said shaft.

33. A downhole well pump system in accordance with claim 30 wherein said pump further comprises at least one impeller blade disposed within said pump portion, said at least one impeller blade adapted for lifting said fluids from said well based on said movement of said shaft.

34. A downhole well pump system in accordance with claim 30 wherein said pump further comprises a blade disposed within said engine portion, said blade effectuating said movement of said shaft based on a flow of said gas across said blade.

35. A downhole well pump system in accordance with claim 30 wherein said pump further comprises at least one impeller blade disposed within said engine portion, said at least one impeller blade effectuating said movement of said shaft based on a flow of said gas across said blade.

36. A downhole well pump system in accordance with claim 30 wherein said pump further comprises at least one turbine blade disposed within said engine portion, said at least one turbine blade effectuating said movement of said shaft based on a flow of said gas across said blade.

37. A downhole well pump system comprising:

a pump adapted to employ pressurized gas for generating a force for lifting fluids from a well, said pressurized gas including gas produced from said well; and a compressor for compressing at least a portion of gas produced from said well to produce said pressurized gas.

38. A downhole well pump system in accordance with claim 37, wherein said compressor is a wellhead compressor disposed proximate said well.

39. A downhole well pump system in accordance with claim 37, wherein said compressor is a central compressor adapted for providing said pressurized gas to said pump via a distribution piping system.

40. A method of producing fluids from a well, the fluids including production gas, said method comprising:

creating, using pressurized gas, a reduced pressure inlet for lifting fluids from the well, the pressurized gas comprising gas produced from the well, the well including a well casing surrounding a tubing string and an annulus between the casing and the tubing string, the annulus being open from a pay zone to a point upwell of a pump disposed in the well and the annulus being in fluid communication with a point adjacent a wellbore opening at the surface; and supplying the pressurized gas via the tubing string to the pump for creating the reduced pressure inlet prior to the pressurized gas entering a sales line.

41. A method in accordance with claim 40 wherein said pump is disposed at a pay zone within a wellbore of said well.

42. A method in accordance with claim 40, further comprising:

pressurizing a portion of said production gas with a wellhead compressor to produce said pressurized gas.

43. A method in accordance with claim 40, further comprising:

pressurizing a portion of said production gas with a central compressor to produce said pressurized gas; and supplying said pressurized gas to said well via a distribution piping system.

44. A method in accordance with claim 40, wherein said fluids comprises liquid and gas, said method further comprising separating said liquid from said gas.

45. A downhole well pump system for pumping fluids from a well, comprising:

a pump mechanism configured to employing pressurized gas to create a reduced pressure inlet for lifting fluids from a well, wherein the pressurized gas comprises gas produced from the well, wherein the pressurized gas is supplied to the pump mechanism via a tubing string prior to the pressurized gas entering a sales line, the well including a well casing surrounding the tubing string and an annulus between the casing and the tubing string, the annulus being open from a pay zone to a point unwell of the pump mechanism disposed in the well and the annulus being in fluid communication with a point adjacent the wellbore opening at the surface.

46. A method in accordance with claim 45 wherein said pump mechanism is disposed at a pay zone within a wellbore of said well.

47. A downhole well pump system in accordance with claim 45, wherein said pump mechanism further comprises at least one check valve at an outlet thereof.

48. A downhole well pump system in accordance with claim 45 further comprising a pump housing, said pump mechanism being disposed within said pump housing.

49. A downhole well pump system in accordance with claim 45 wherein said pump mechanism is attached to a production tubing string in said well.

50. A downhole well pump system in accordance with claim 45, wherein said fluid comprises liquid and gas, said pump system further comprising a separator for separating said liquid from said gas.

51. A downhole well pump system for pumping fluids from a well comprising:

a compressor for controlling a pressure of a pressurized gas; and a pump mechanism adapted for employing said pressurized gas to create a reduced pressure inlet for lifting fluids from a well, wherein said pressurized gas comprises gas produced from said well, said well including (a) a well casing surrounding a first tubing string and (b) an annulus between said casing and said first tubing string, said annulus being open from said pay zone to a point upwell of a pump disposed in said well and said annulus being in fluid communication with a point adjacent the wellbore opening at the surface.

52. A downhole well pump system in accordance with claim 51, wherein said compressor is a wellhead compressor.

53. A downhole well pump system in accordance with claim 51, wherein said compressor is a central compressor, said downhole well pump system further comprising a distribution piping system for carrying said pressurized gas to said well.

54. A method of producing fluids from a well having a wellbore opening at the surface, a pay zone, a casing, the method comprising:

disposing a first tubing string within the casing such that an annulus between the casing and the first tubing string is in fluid communication between a point proximate the pay zone and a point proximate the wellbore opening;

disposing a pump in the first tubing proximate the pay zone, the pump configured to use a pressurized gas to generate a force for lifting the fluids to the wellbore opening;

pressurizing a gas, the gas including gas produced from the well; and supplying the pressurized gas to the pump.

55. A method in accordance with claim 54, wherein pressurizing a gas including gas produced from the welt comprises:

separating gases from the produced fluid; and compressing the separated gases.

56. A method in accordance with claim 54, wherein the gas produced from the well includes gas separated from the produced fluid and gas from the annulus.

57. A method in accordance with claim 54, wherein supplying the pressurized gas to the pump comprises supplying a first portion of the pressurized gas to the pump and a second portion of the pressurized gas to a sales line.

58. A method in accordance with claim 57, further comprising controlling a pressure of the first portion of the pressurized gas to control operation of the pump.

59. A system in accordance with claim 57, further comprising a valve for controlling a pressure of the first portion of the pressurized gas to control operation of the pump.

60. A system in accordance with claim 57 further comprising collection piping for collecting gas produced from a plurality of wells, wherein the compressor pressurizes the gas collected gas.

61. A system in accordance with claim 60 further comprising distribution piping coupled to the compressor for supplying the pressurized gas to pumps in a plurality of wells.

62. A system for producing fluids from a well having a wellbore opening at the surface, a pay zone, and a casing, the system comprising:

a first tubing string disposed within the casing such that an annuls between the casing and the first tubing string being in fluid communication between a point proximate the pay zone and a point proximate the wellbore opening:

a pump disposed in the first tubing proximate the pay zone, the pump configured to use a pressurized gas to generate a force for lifting the fluids to the wellbore opening;and a compressor coupled to the well and to the pump, for pressurizing a gas including gas produced from the well and supplying the pressurized gas to the pump.

63. A system in accordance with claim 62, further comprising a separator for separating gases from the produced fluid, wherein the gas produced from the well includes gases separated from the fluid.

64. A system in accordance with claim 63, wherein the gas produced from the well includes gas from the annulus.

65. A system in accordance with claim 62, wherein supplying the pressurized gas to the pump comprises supplying a first portion of the pressurized gas to the pump and a second portion of the pressurized gas to a sales line.

* * * * *

UNITED STATES PATENT AND TRADEMARK OFFICE

CERTIFICATE OF CORRECTION

PATENT NO. : 7,270,186 B2
APPLICATION NO. : 10/492732
DATED : September 18, 2007
INVENTOR(S) : Kenneth G. Johnson It is certified that error appears in the above-identified patent and that said Letters Patent is hereby corrected as shown below:

Column 13:
line 9, delete “welt” and insert -- well --.

Column 14:
line 8, delete “annuls” and insert -- annulus --.

Signed and Sealed this

Twenty-seventh Day of November, 2007

JON W. DUDAS
*Director of the United States Patent and Trademark Office*